US007681366B2

(12) United States Patent
De Gobbi

(10) Patent No.: US 7,681,366 B2
(45) Date of Patent: Mar. 23, 2010

(54) CURTAIN WALL ANCHOR SYSTEM

(75) Inventor: Alberto De Gobbi, Suffield, CT (US)

(73) Assignee: Permasteelisa Cladding Technologies, L.P., Windsor, CT (US)

( * ) Notice: Subject to any disclaimer, the term of this patent is extended or adjusted under 35 U.S.C. 154(b) by 105 days.

(21) Appl. No.: 11/724,276

(22) Filed: Mar. 15, 2007

(65) Prior Publication Data

US 2008/0222981 A1 Sep. 18, 2008

(51) Int. Cl.
*E04H 1/00* (2006.01)

(52) U.S. Cl. ..... 52/235; 52/293.3; 52/483.1; 52/506.04; 52/506.06

(58) Field of Classification Search ..... 52/235, 52/463, 704, 483.1, 489.1, 421, 292, 293.1, 52/293.3, 297, 506.04, 506.05, 506.06, 698, 52/711, 137
See application file for complete search history.

(56) References Cited

U.S. PATENT DOCUMENTS 3,936,986 A 2/1976 Steel
4,899,508 A * 2/1990 Biebuyck ..... 52/235
4,905,444 A * 3/1990 Semaan et al. ..... 52/710
4,951,438 A * 8/1990 Thoresen ..... 52/252
5,067,292 A * 11/1991 Finean ..... 52/235
5,118,060 A * 6/1992 Spronken ..... 248/218.4
5,548,939 A * 8/1996 Carmical ..... 52/707
6,442,311 B1 * 8/2002 Barbarossa et al. ..... 385/37
6,658,804 B2 * 12/2003 Leytes et al. ..... 52/235
6,729,080 B1 * 5/2004 Zambelli et al. ..... 52/167.1
2003/0033764 A1 * 2/2003 Ting ..... 52/235
2004/0079038 A1 4/2004 Crooker, Jr.
2007/0039258 A1 * 2/2007 Walker, III ..... 52/235

* cited by examiner

*Primary Examiner*—Richard E Chilcot, Jr.
*Assistant Examiner*—Branon C Painter
(74) *Attorney, Agent, or Firm*—Dickstein Shapiro LLP

(57) ABSTRACT

A curtain wall anchor system is provided. The curtain wall anchor system has an anchor assembly comprising an anchor for attaching a curtain wall assembly to a building structure. The anchor system further comprises an enclosure for the anchor, wherein the enclosure defines an area adjacent the anchor. The enclosure also has a removable portion for allowing access to the anchor.

12 Claims, 13 Drawing Sheets

CURTAIN WALL ANCHOR SYSTEM

BACKGROUND OF THE INVENTION

Disclosed embodiments of the invention relate generally to building cladding materials, such as curtain walls, and more particularly to anchor systems for securing curtain walls to building structures.

Many buildings of current construction, particularly commercial buildings, derive no structural support from their exterior walls. These walls simply isolate the interiors of the buildings from the environment outside the buildings, and as such are called curtain walls. "Curtain wall" is a term typically used to describe a building facade which does not carry any dead load from the building other than its own dead load. These loads are transferred to the main building through connections, such as anchors, at floors or columns of the building.

A curtain wall is designed to resist air and water infiltration, wind forces acting on the building, seismic forces, and its own dead load forces. Curtain walls can include heavy wall types such as brick veneer and pre-cast concrete panels. Curtain walls are also typically designed with an extruded aluminum frame, although the first curtain walls were made of steel. The aluminum frame is typically filled with glass, which provides an architecturally pleasing building, as well as benefits such as daylighting and environmental control. Other common fills include stone veneer, metal panels, louvers, and operable windows or vents.

A typical curtain wall assembly 220 on a building structure 208 is shown in FIG. 1. A curtain wall assembly 220 comprises curtain wall sections 200 having multiple panels 202 arranged side-by-side and/or in tiers. The curtain wall assembly 220 also comprises structural members 204, called mullions, which separate and secure the curtain wall panels 202. The mullions 204 are secured to the building structure 208 by anchors 206. The anchors 206 secure the mullions 204 to structural components that form the frame of the building structure 208. The anchors 206 typically secure the mullions 204 to steel girders, columns or cast concrete decks. The curtain wall panels 202 are typically attached to the mullions 204 with fastening devices that may have a variety of configurations. Configuration of such fastening devices depends on the nature of the curtain wall panel 202 to be fastened.

Present building construction techniques include pouring concrete floors 210 and interior dividing walls throughout one level, and forming one level after another until a desired number of levels have been completed. At this stage, the anchors 206 are mounted to a concrete floor 210, or several floors, or the roof 212 of a building structure 208. Thereafter, an exterior shell of the building structure 208 is created by attaching the mullions 204 to the anchors 206, and then attaching curtain wall sections 200 to the mullions 204. Alternatively, the curtain wall sections 200 may be attached directly to the anchors 206.

A typical method for attaching curtain walls to a building structure is shown in FIGS. 2-5. With reference to FIG. 2, a portion of a building structure 120 ("building structure") prior to attachment of a curtain wall is shown. The portion of the building structure 120 may be a roof or one of the floors of the building structure 120, having a horizontal top surface 124. The building structure 120 may have several top surfaces 124 and a series of supports 122.

The assembly of a curtain wall anchor system initially comprises providing a support with a concrete block-out assembly, generally designated by numeral 100. The assembly 100 is installed on a concrete pour stop 126, which is mounted on the top surface 124 of the building structure 120. The concrete pour stop 126 defines a space into which concrete would be poured. The assembly 100 typically comprises attaching a U-channel 102 to a stud 104. A wood/steel shim 105 may be provided under the stud 104 for leveling and/or other reasons. Then, a wood or foam block-out 108, which is typically made at the construction site, is placed or mounted over the U-channel 102. Thereafter concrete is poured into the concrete pour stop 126. Concrete, which may be reinforced by steel bars 110, would typically be poured up to a level indicated by numeral 128. The assembly 100 may be tied to the steel bars 110 for stability during pouring of the concrete. After the concrete is cured, the block-out 108 would be removed. Removal of the block-out 108 would create an opening 130 (FIG. 3) over the U-channel 102 for further construction of the anchor system.

In use, workers at the construction site would have to fabricate each support with a concrete block-out assembly 100 by first attaching the stud 104 to the concrete pour stop 126, typically by welding to shims 105 (if metal) and/or tying to steel bars 110. Then, the U-channel 102 would be welded or otherwise attached to the stud 104. The piece of wood or foam functioning as the block-out 108 would then have to be made and attached to the U-channel 102 to prevent the soon to be poured concrete from covering an area over the top of the U-channel 102. Prior to attachment of the block-out 108, internal surfaces and side opening of the U-channel 102 were typically filled with foam 106, or a similar material, to protect the internal surfaces and opening of the U-channel 102 from the soon to be poured concrete. The internal surfaces and opening of the U-channel 102 typically contained components for further construction of the anchor system, and, thus, had to be protected the from poured concrete.

A series of additional support(s) with concrete block-out assemblies 100 would then be constructed by the workers along an edge or edges of the building structure 120, as shown in FIG. 3. With reference to FIGS. 4 and 5, concrete 112 would then be poured to fill the concrete pour stop 126. Thereafter, all of the block-outs 108 would be removed by the workers to expose open areas 130 in the concrete 112, above the U-channels 102. The workers would then remove the foam 106 to expose an internal mechanism inside the u-channels 102 for affixing an anchor 114 and associated components to the u-channel 102. An example of such an internal mechanism is an internal engagement 117, for receiving a threaded T-bolt 116 as shown in FIG. 5.

After installation of the threaded T-bolt 116, the anchor 114 would then be attached to the threaded stud 116 by a nut 118, for example. The anchor 114 would typically have an engagement portion 115. In use, mullions and curtain wall sections would be attached to the anchors 114 via the engagement portions 115 to complete the building structure 120, as described above.

Typical methods and structures providing curtain wall anchor systems are deficient in several aspects. First, installation of the anchor system at the job site is very time consuming and thus expensive. Workers at the job site are required to manufacture wood or foam block-outs 108 for each anchor system 100. Workers are also required to attach studs 104, U-channels 102, fill the U-channels 102 with protective material 106, and then install the block-outs 108. After the concrete 112 is poured and the block-outs 108 are removed, the workers are required to clean the internal surfaces and openings of the U-channels 102, and thereafter attach anchors 114 and associated components to each anchor system 100. Such a procedure is time consuming and costly.

Moreover, the multiple installation steps discussed above have to be manually repeated for each anchor system, and often different workers perform the required labor for different anchor systems. This leads to inconsistent results, for example, due to all of the components, e.g., studs, U-channels, block-outs and anchors, having to be installed by different workers and usually under varying and stringent time requirements. As such, quality control varies and may be compromised.

With costs being at least partly dependent upon man hours involved and equipment used at a building construction site, there is a need to complete construction according to the building codes in the shortest possible time, and, if possible, reduce the amount of components used. Also, there is a need to achieve more consistent results in manufacturing and installation of the anchor assemblies. Thus, an installation-ready anchor system for improving efficiency and consistency is desired.

BRIEF DESCRIPTION OF THE DRAWINGS

The advantages and features of the invention will become more apparent from the detailed description of exemplary embodiments provided below with reference to the accompanying drawings in which.

DETAILED DESCRIPTION OF THE INVENTION

Figure 1:
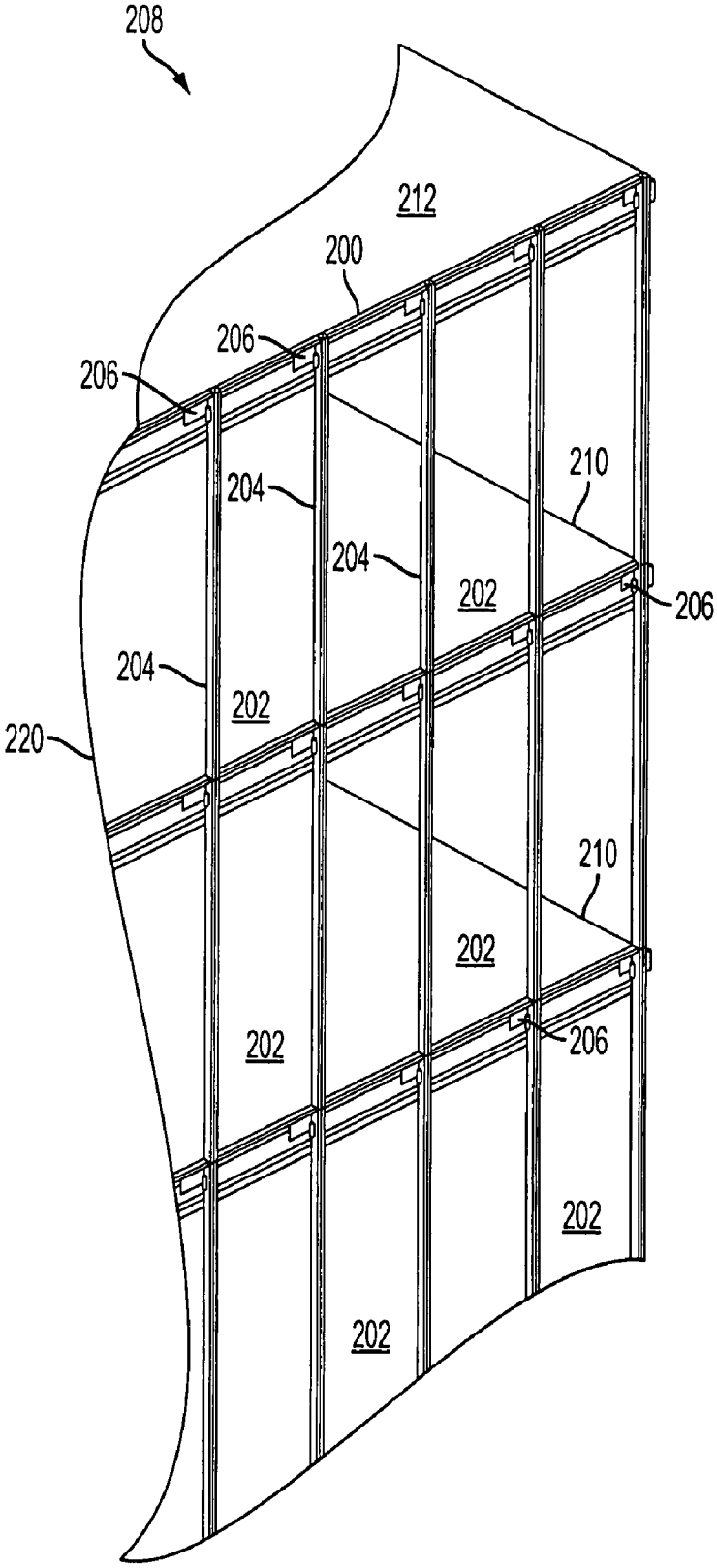
FIG. 1 is an illustration of a curtain wall on a building structure.

In the following detailed description, reference is made to the accompanying drawings, which form a part hereof and illustrate exemplary embodiments of the invention. In the drawings, like reference numerals describe substantially similar components throughout the several views. These embodiments are described in sufficient detail to enable those skilled in the art to practice the inventions, and it is to be understood that other embodiments may be utilized, and that structural, logical and procedural changes may be made.

An installation-ready anchor system according to embodiments of the invention is illustrated in FIGS. 6A-9. The anchor system, shown in top and side-sectional views in FIGS. 6A-6C and generally designated by numeral 2, comprises anchor assembly 10 within an enclosure 8. In an embodiment, the enclosure 8 comprises a top cover 16, three sidewalls 14 and a front cover 12. The front cover 12 has an opening 12*a* for the anchor clip 26 to slide through, as will be discussed in greater detail below. The enclosure 8 encloses an area 9, adjacent a base plate 4 and the anchor assembly 10. The enclosure 8 may be tack welded to the base plate 4. As shown in FIG. 6C, the area 9 may be above the base plate 4 and anchor assembly 10. In a preferred embodiment, the base plate 4 comprises steel, the enclosure 8 comprises a galvanized steel sheet and the front cover 12 comprises plastic. Alternatively, these components may comprise other materials, such as metals, plastics or fiberglass materials, as desired.

Figure 7:
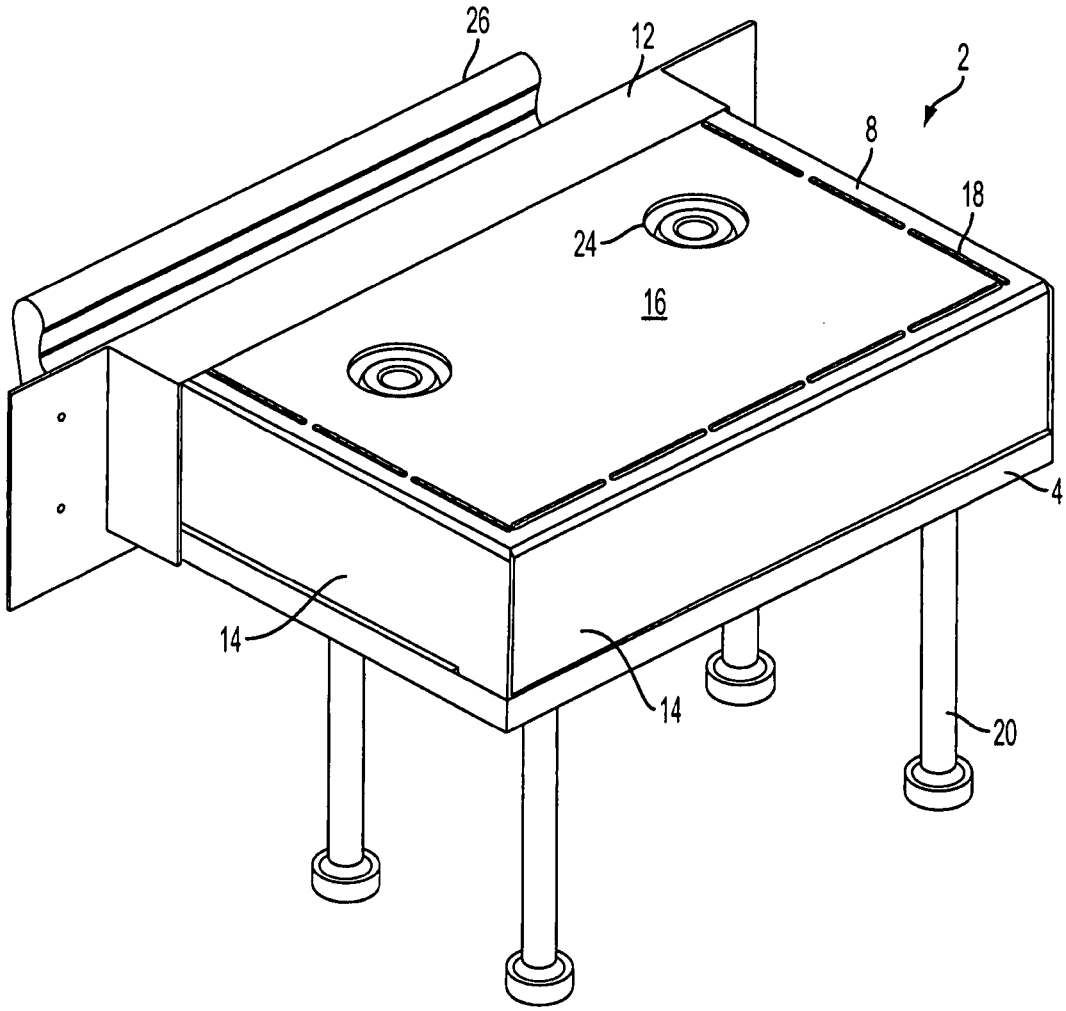
FIG. 7 is a perspective view of an anchor system according to an embodiment of the invention.
Figure 8A:
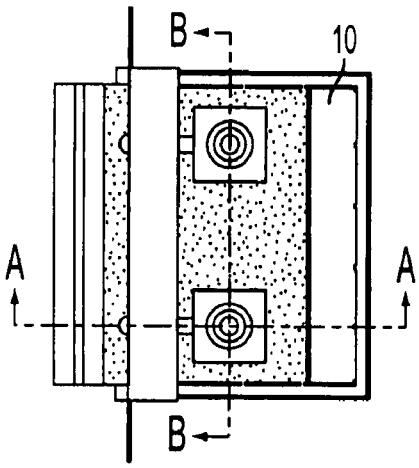
FIGS. 8A, 8B and 8C are top and side sectional views of an anchor system according to an embodiment of the invention.
Figure 8B:
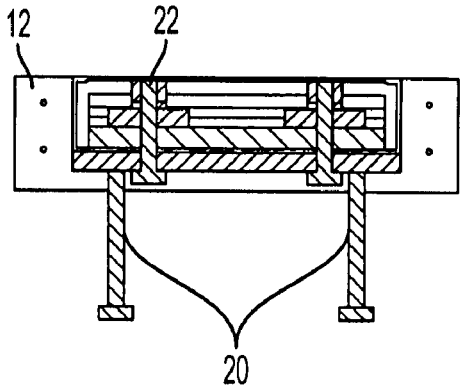
Figure 8C:
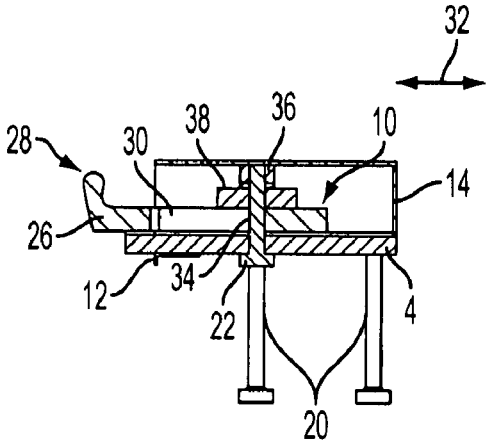
Figure 9:
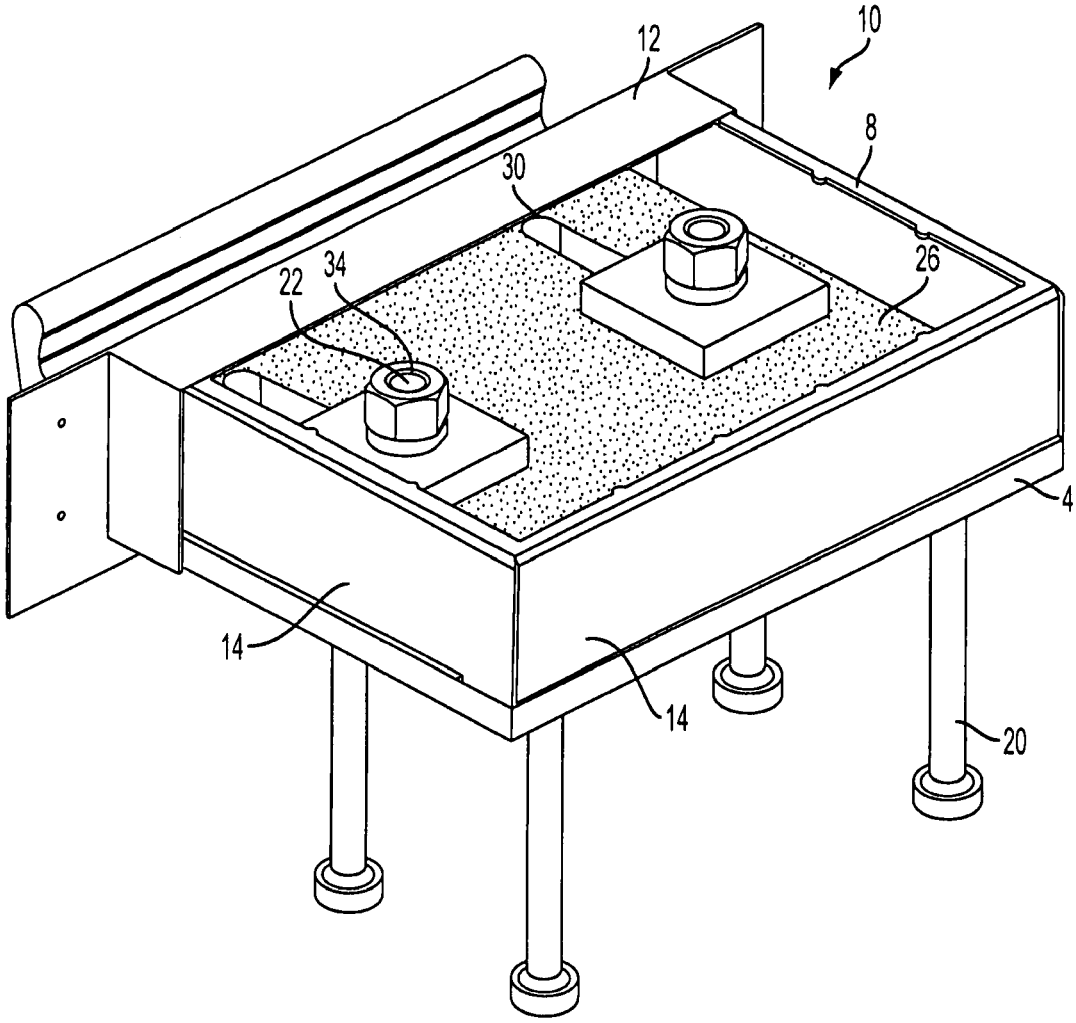
FIG. 9 is a perspective view of an anchor system according to an embodiment of the invention.

The base plate 4 is preferably mounted on studs 20. Studs 20, which may be welded to the base plate 4, extend downward from the base plate 4. Bolts 22, or similar devices, are welded to base plate 4. Bolts 22 extend upward from the base plate 4, as shown, and are discussed in more detail below. FIG. 7 shows a perspective view of the installation-ready anchor system 2. As illustrated, the top cover 16 of the enclosure 8 has shear markings 18 and access opening markings 24 for clearing and access to the anchor assembly 10 during installation, as will be discussed in more detail below. As shown, in an embodiment the access openings may be removed at this stage.

The anchor assembly 10 is further discussed with reference to FIGS. 8A-8C and 9. The anchor assembly 10 comprises an anchor clip 26, which is provided over the base plate 4. The engagement bolts 22, have a threaded portion 34 that extends above the base plate 4. The anchor clip 26 has a slot 30 (FIGS. 8C and 9) that allows the threaded portion 34 of the bolt 22 to extend through the anchor clip 26. Although the slot 30 is illustrated as being internal to the anchor clip 26, the slot 30 may be formed at an edge of the anchor clip 26.

A nut 36 and washers 38 are provided on the treaded portion 34 to secure the anchor clip 26 to the base plate 4. When the nut 36 is loose, the anchor clip 26 can slide, or otherwise be moved relative to the base plate 4 along directional arrow 32. The anchor clip 26 has an engagement portion 28. The anchor assembly 10 may comprise the anchor clip 26 and associated components.

Figure 10:
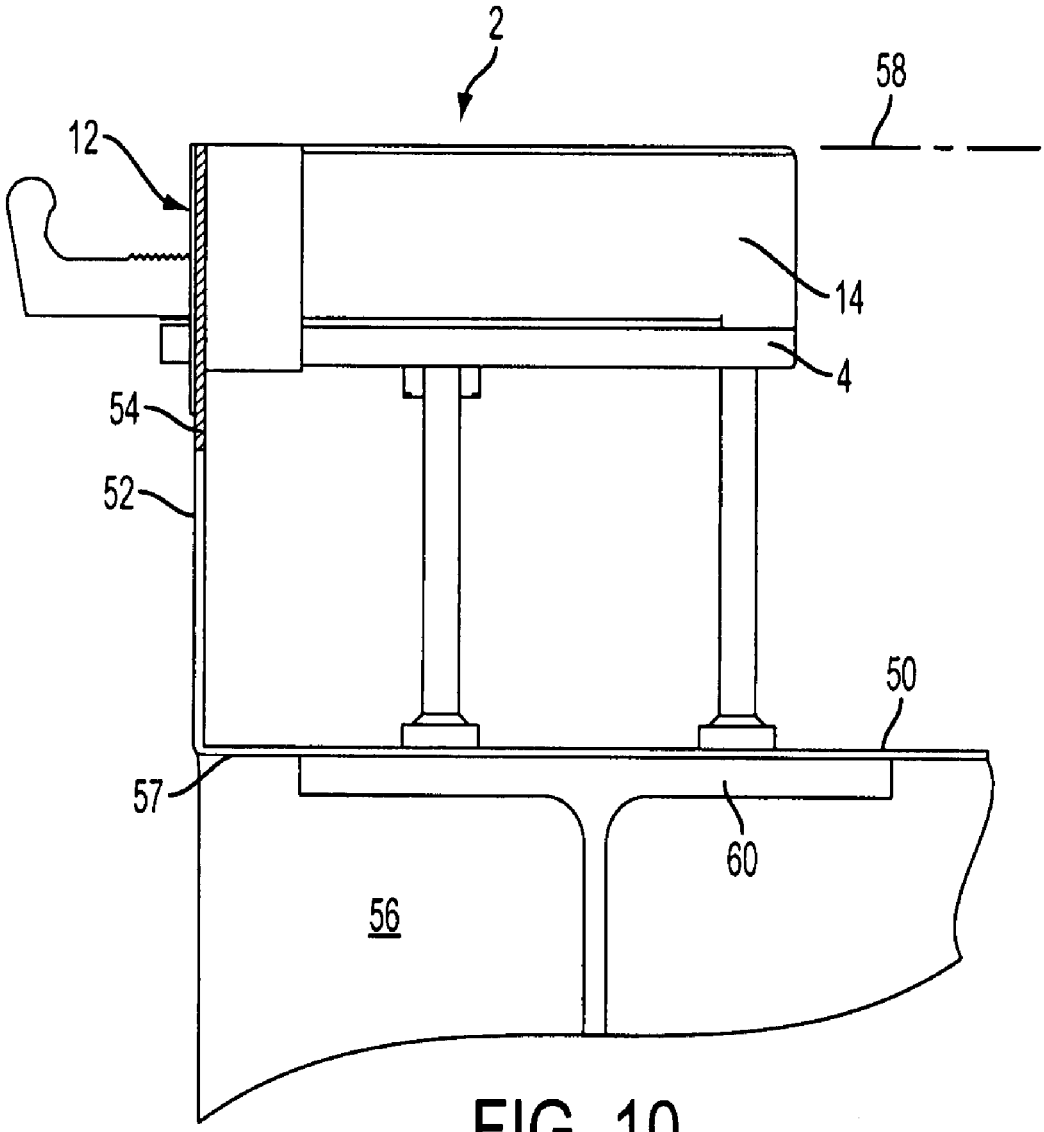
FIG. 10 is an illustration of the anchor system of FIGS. 6-9 in use.

FIGS. 10-15 illustrate the installation-ready anchor system 2 in use. FIG. 10 shows the anchor system 2 installed over a surface 57 of a building structure 56. The surface 57 may be a portion of a roof or floor of the building structure 56, and may be supported by supports 60. A pour stop 50 is typically provided over the building surface 57, and under the anchor system 2. The pour stop 50 has vertical surfaces 52, and provides a shell into which a building material, such as concrete, will be poured. The vertical surfaces 52 may have removable cut-out portions 54 corresponding to the front covers 12 of the anchor systems 2. In a preferred embodiment, the front cover 12 functions as an interface between the anchor system 2 and the pour stop 50.

Figure 2:
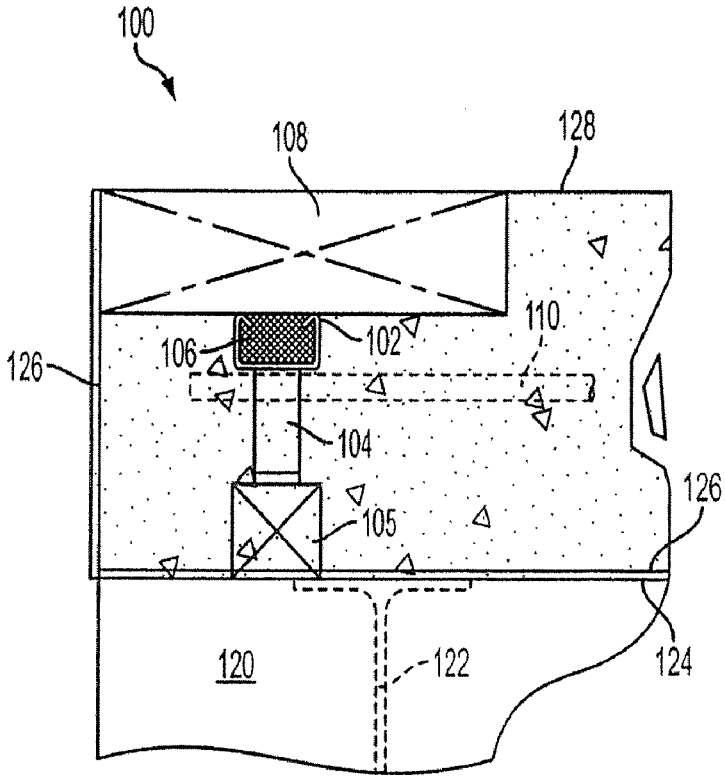
FIG. 2 (PRIOR ART)
FIG. 2 is a side view of a typical curtain wall anchor system.
Figure 3:
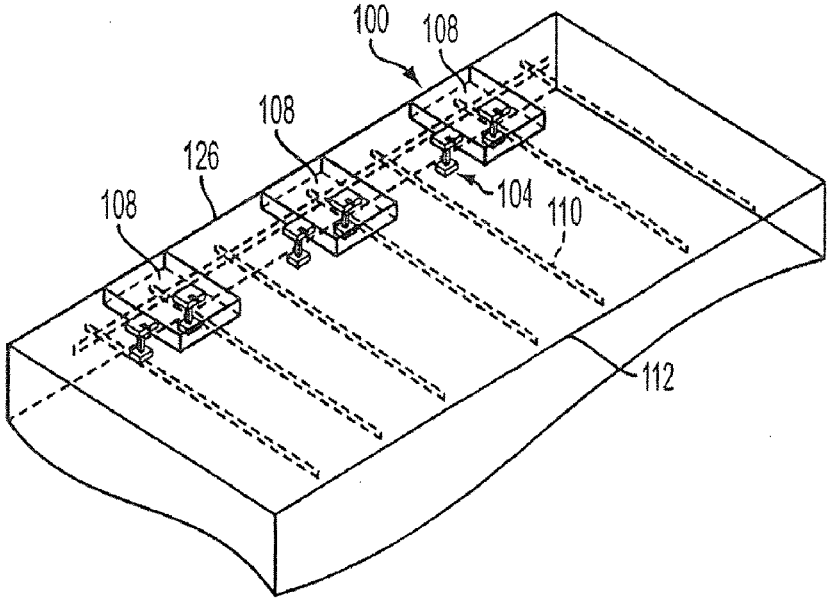
FIG. 3 (PRIOR ART)
FIG. 3 is a perspective view of the curtain wall anchor system of FIG. 2 in use.
Figure 4:
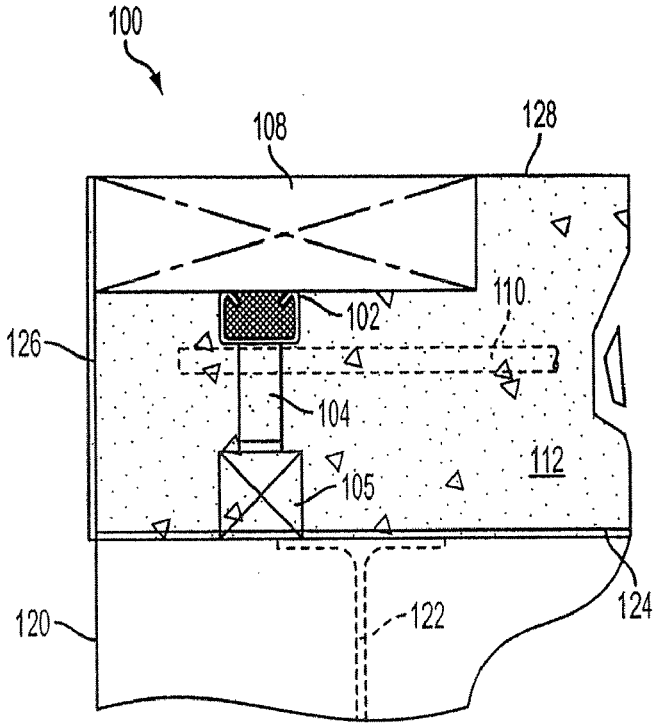
FIG. 4 (PRIOR ART)
FIG. 4 is a side view of the curtain wall anchor system of FIG. 2 in use.
Figure 5:
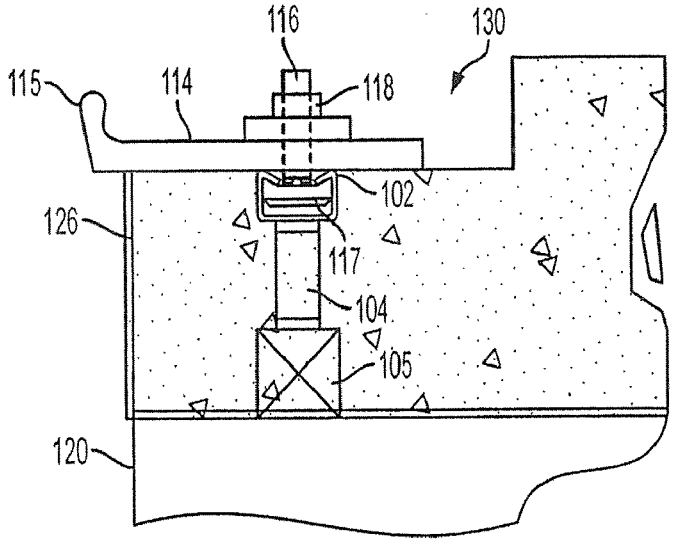
FIG. 5 (PRIOR ART)
FIG. 5 is a side view of the curtain wall anchor system of FIG. 2 in use.
Figure 6A:
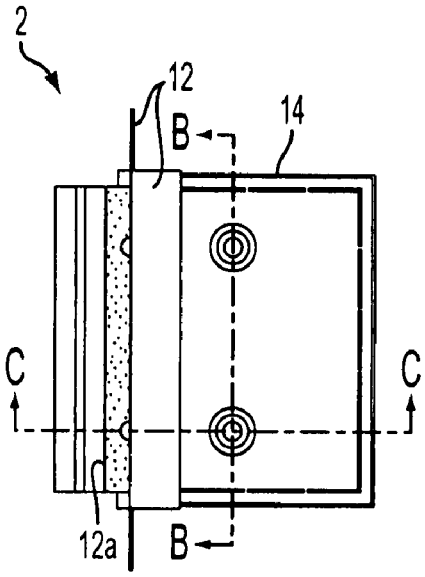
FIGS. 6A, 6B and 6C are top and side sectional views of an anchor system according to an embodiment of the invention.
Figure 6B:
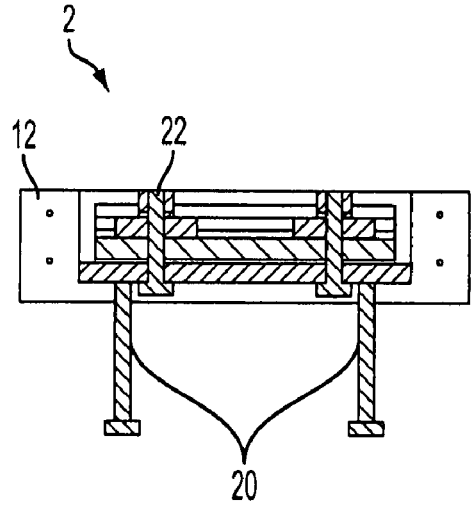
Figure 6C:
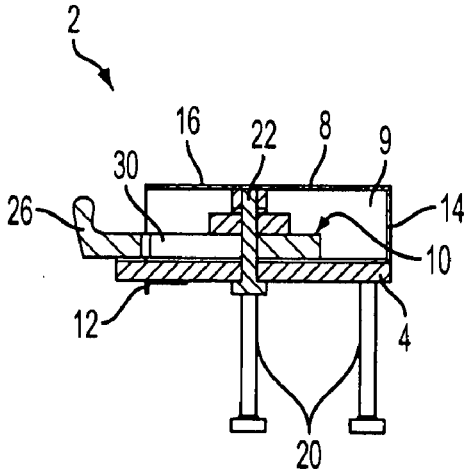
Figure 11:
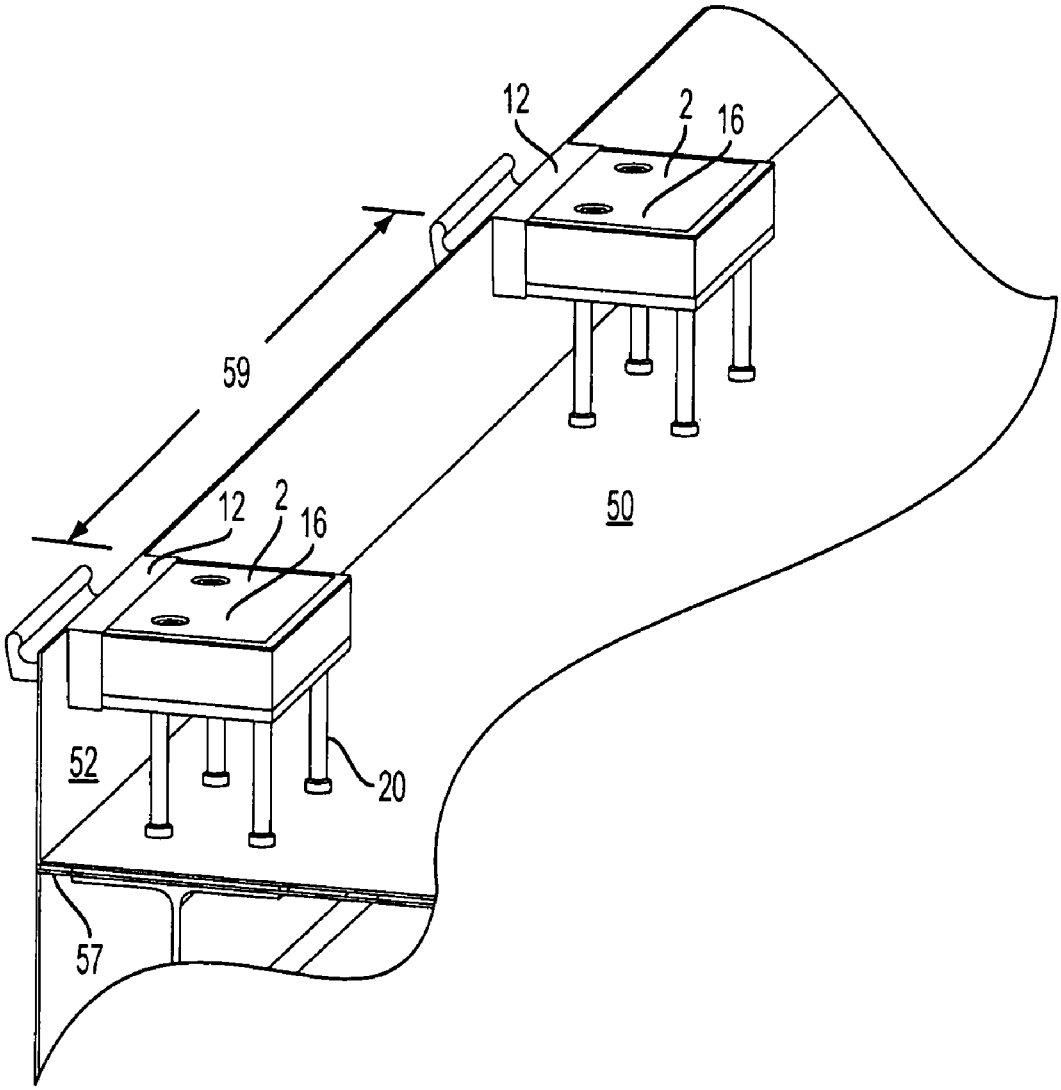
FIG. 11 is an illustration of the anchor system of FIGS. 6-9 in use.

FIG. 11 shows a perspective view of several anchor systems 2 installed on the pour stop 50 of the building structure 56. The anchor systems 2 can be installed by tack welding studs 20 to the pour stop 50, or other portion of the surface 57. Alternatively, the studs 20 may be attached by any other suitable means, such as tying to concrete steel bars 110 (FIGS. 2-4). Adjacent anchor systems 2 are installed at predetermined intervals 59 along an edge of the building structure 56. The anchor systems 2 are placed approximately at locations where curtain wall supports, such as mullions, for the curtain wall assembly will be located. Individual anchor systems 2 are stable due to having four studs 20, and therefore tying anchor systems 2 to steel bars 110 for stability is no longer required.

Thereafter, a building material such as concrete is poured into the pour stop 50 to a level indicated by numeral 58 in FIG. 10. Preferably, top covers 16 of the anchor systems 2 remain visible after concrete is poured, or are otherwise marked for easy identification of locations of the anchor systems 2 for further installation steps. The concrete may be poured to a level slightly below the top surfaces 16 of the anchor systems 2 to achieve this purpose. In a preferred embodiment, concrete is poured proximate the sidewalls 14 of the enclosure 8. Alternatively, the concrete may be poured proximate only the studs 20 of the anchor system 2.

Figure 12:
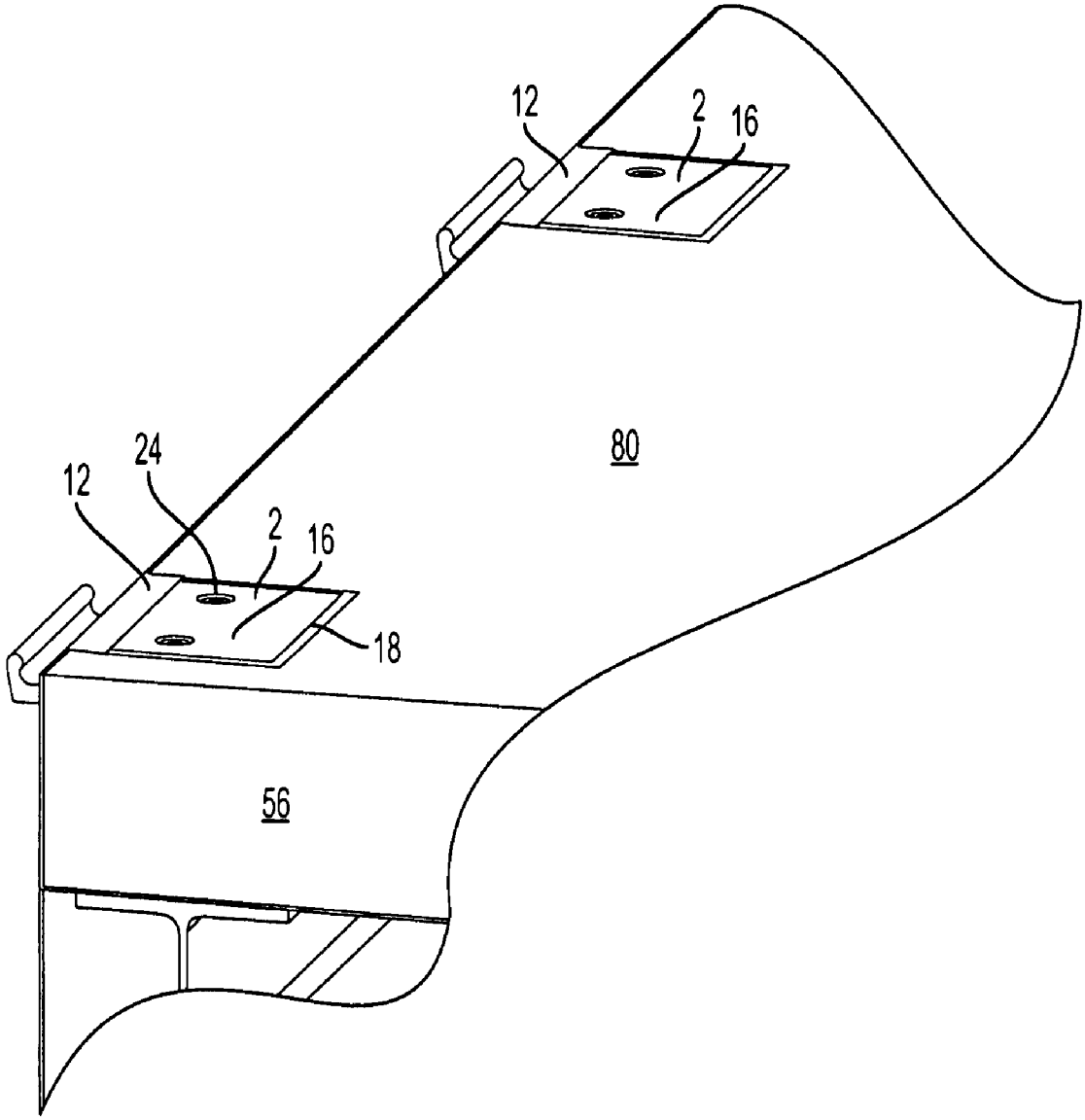
FIG. 12 is an illustration of the anchor system of FIGS. 6-9 in use.
Figure 13A:
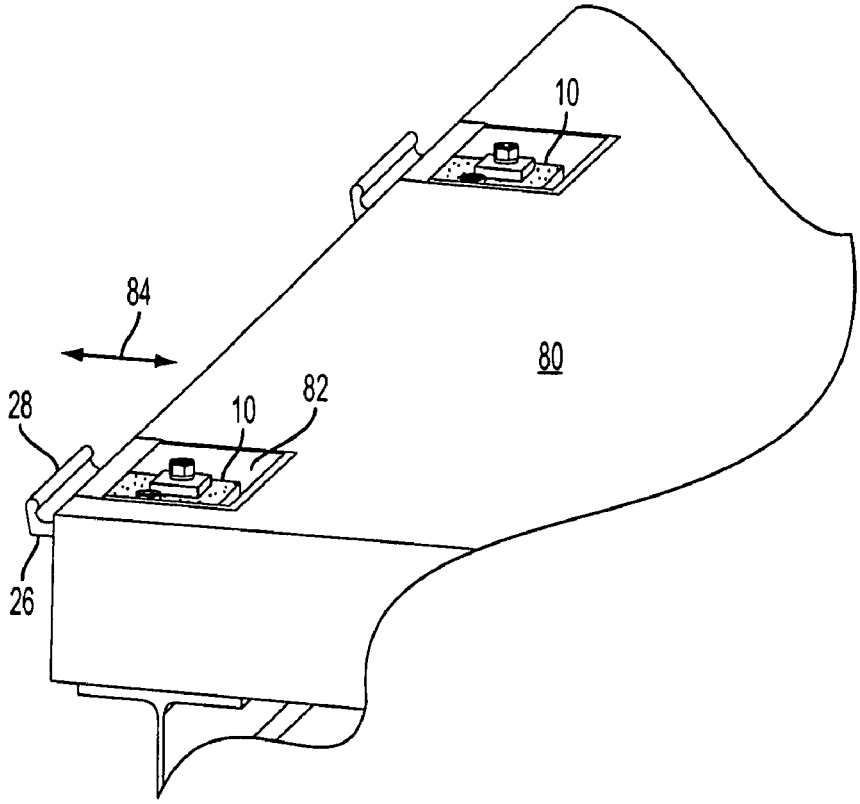
FIGS. 13A and 13B are illustrations of the anchor system of FIGS. 6-9 in use.
Figure 13B:
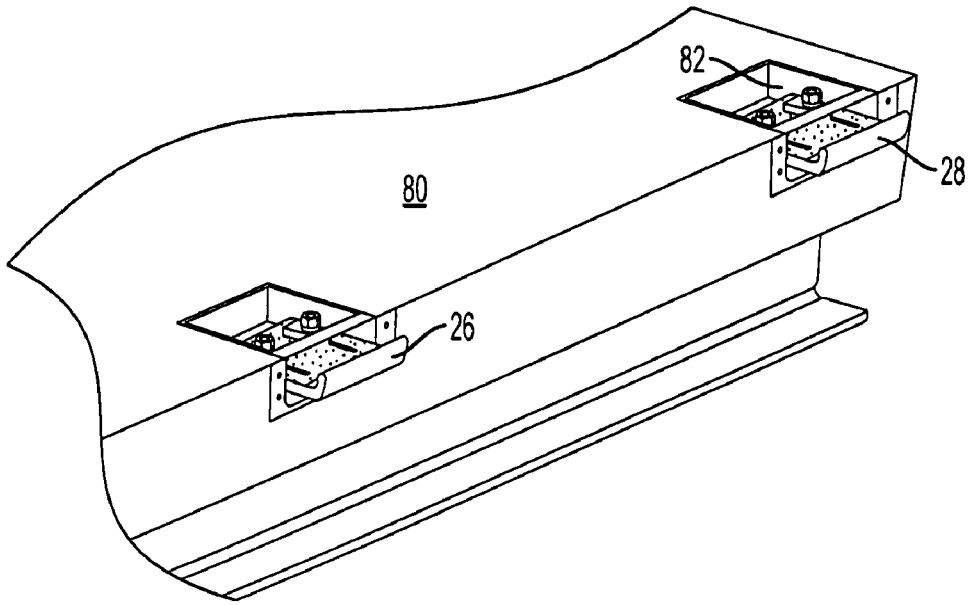
Figure 14:
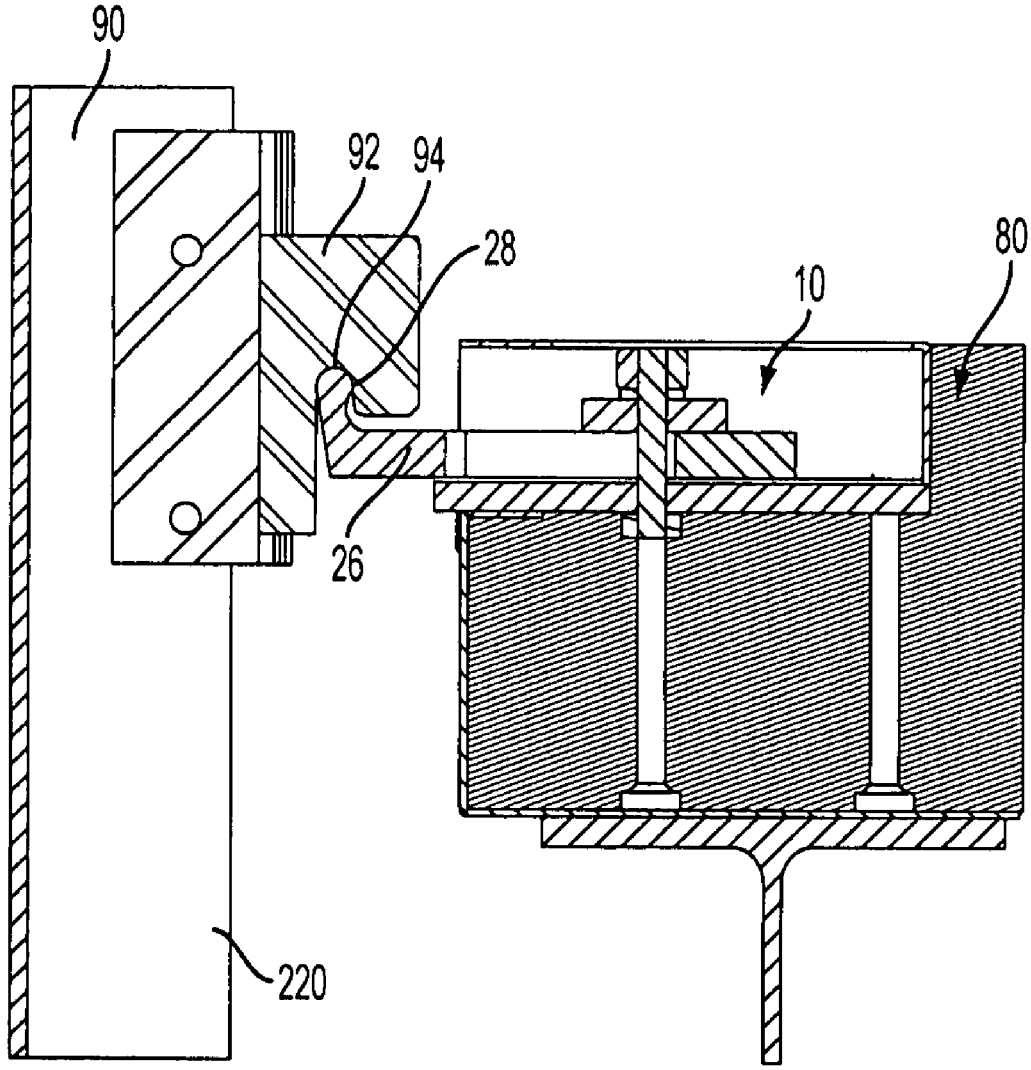
FIG. 14 is an illustration of the anchor system of FIGS. 6-9 in use.

FIGS. 12, 13A and 13B show the anchor systems 2 after concrete 80 has been poured and has cured. At this stage, the top cover 16, or portions thereof, of the enclosure 8 are removed from the anchor systems 2 to expose the anchor assemblies 10. The top covers 16 may be completely removed, or portions of the top covers 16 can be removed along the shear-markings 18 or along the access opening markings 24 (FIGS. 7,12). The markings 18, 24 may be perforated to facilitate removal. Removal of the top covers 16 or portions thereof exposes openings 82 in concrete 80. The openings 82 are adjacent—the anchor assemblies 10 and allow workers access to the anchor assemblies 10. Sidewalls 14 of the enclosure 8 may or may not be removed, as desired.

After access is gained to the anchor assemblies 10, installation of the curtain wall assembly can be accomplished. For example, with reference to FIGS. 13A-15, the anchor clips 26 of the anchor assemblies 10 can be slid horizontally in direction of arrow 84. The anchor clips 26 may be extended in direction 84 such that the engagement portions 28 of the anchor clips 26 are positioned to attach components of the curtain wall assembly to the anchor clips 26. An exemplary attachment structure and method are shown with reference to FIGS. 14 and 15. A mullion 90 of a curtain wall assembly 220 is provided with an engagement member 92 that has an engagement surface 94. The mullion engagement surface 94 is engaged with the anchor clip engagement portion 28, thereby attaching the mullion 90 to the anchor assembly 10. Thereafter, additional mullions 90 are likewise attached, as needed.

Figure 15:
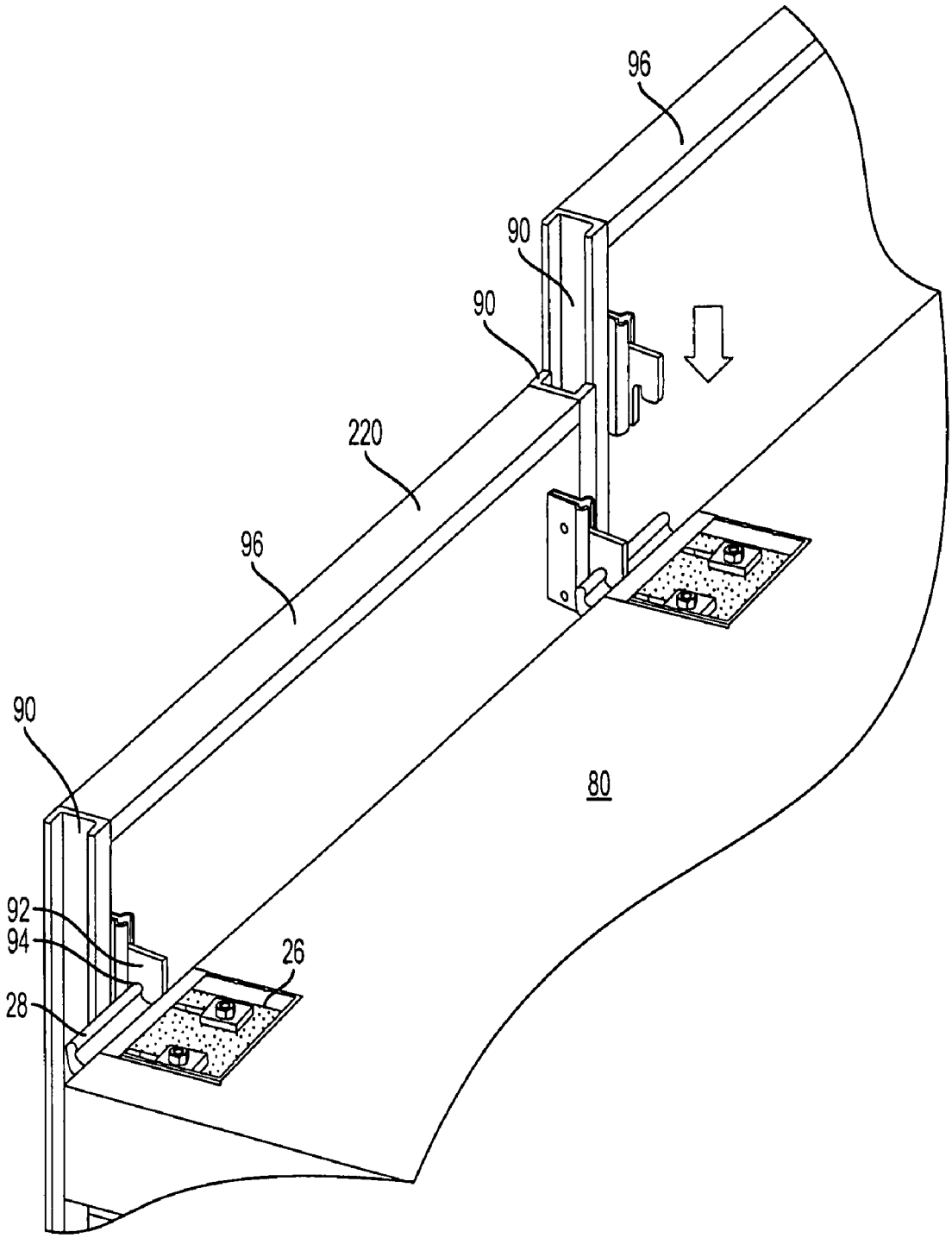
FIG. 15 is an illustration of the anchor system of FIGS. 6-9 in use.

With reference to FIG. 15, curtain wall sections 96 are attached to the mullions 90 to form a curtain wall assembly on the building structure 56. As shown, multiple mullions 90 may be attached to a single anchor clip 26. Alternatively, curtain wall sections 96 may be attached to mullions 90 prior to installing the mullions 90 on the anchor clips 26 of the anchor assemblies 10. Also, curtain wall sections 96 may be attached directly to the anchor assemblies 10.

Thus, methods for manufacturing and using, and structures for an installation-ready anchor system have been provided. The components of the anchor system can be fabricated and assembled, and then shipped to the building construction site as a complete installation ready system. This assures excellent quality control during fabrication, assembly and on site installation of the anchor system. In addition, the invention allows labeling of the anchor systems prior to shipping. Labeling provides a significant advantage in tracking production, inventories, installation and traceability of parts or components. Importantly, manufacturing, shipping and installing the anchor system as one-piece system greatly simplifies anchor assembly and curtain wall installation processes. In addition, fewer components are used at the construction site to form anchor assemblies.

The installation-ready anchor system of the invention reduces the steps typically required during installation. For example, forming and installing the block-outs, and clearing of the block-outs—steps that involve significant amount of on site labor—are eliminated. The result is significant labor cost savings during the most expensive part of the anchor installation process—the on site work. Another benefit is added flexibility as to anchor system layout. The installation-ready anchor system of the invention may be modified to suit wide range of load and size requirements.

While various embodiments have been described above, it should be understood that they have been presented by way of example, and not limitation. For example, embodiments of the anchor assemblies may be employed with a vertical surface. It will be apparent to persons skilled in the relevant art(s) that various changes in form and detail can be made therein.

What is claimed as new and desired to be protected by Letters Patent of the United States is:

1. A curtain wall anchor comprising:

an anchor assembly for attaching a curtain wall assembly to a building, said anchor assembly comprising:

a slotted portion including at least one slot, an engagement portion for interfacing with the curtain wall assembly, and an engagement bolt and nut; and an enclosure comprising a base plate, top cover, three sidewalls, and a front cover including an opening for at least the engagement portion of the anchor assembly to extend through, said enclosure defining an area adjacent said engagement portion of the anchor assembly, said top cover of said enclosure having a removable portion for allowing access to said slotted portion of said anchor assembly while said anchor is in use, said slot extending longitudinally in a direction approximately parallel to the two sidewalls, and approximately perpendicular to the remaining sidewall and front cover, and said engagement bolt extending through said base and said slot to engage the nut, wherein at least a portion of said top cover is removable and replaceable in use.

2. The curtain wall anchor of claim 1, wherein said slotted portion and engagement portion are moveable.

3. The curtain wall anchor of claim 1, wherein said top cover has markings identifying said at least a portion of said top to be removed while said anchor is in use.

4. The curtain wall anchor of claim 3, wherein said markings are perforations.

5. The curtain wall anchor of claim 1, wherein said enclosure top cover further comprises an opening for exposing the nut of the anchor assembly.

6. The curtain wall anchor of claim 1, wherein said enclosure comprises more than one supporting stud, one of the more than one studs being engageable with a portion of said anchor.

7. The curtain wall anchor of claim 1, wherein said nut is separated from said slotted portion by a washer.

8. A method of manufacturing a curtain wall anchor, comprising:

providing an anchor assembly for attaching a curtain wall assembly to a building, the anchor assembly comprising:

a slotted portion including at least one slot, an engagement portion for interfacing with the curtain wall assembly,and an engagement bolt and nut; and providing an enclosure comprising a base plate, top cover, three sidewalls, and a front cover including an opening for at least the engagement portion of the anchor assembly to extend through, said enclosure defining an area adjacent said engagement portion of the anchor, said top cover of said enclosure having a removable portion for allowing access to said slotted portion of said anchor assembly while said anchor is in use, said slot extending longitudinally in a direction approximately parallel to the two sidewalls, and approximately perpendicular to the remaining sidewall and front cover, and extending said engagement bolt through said base and said slot to engage the nut, wherein at least a portion of said top cover is removable and replaceable during use.

9. The method of claim 8, wherein said slotted portion and said engagement portion are adjusted to appropriately position said curtain wall assembly.

10. The method of claim 8, further comprising providing said top cover with markings identifying portions of said top to be removed while said anchor is in use.

11. The method of claim 10, wherein said markings are perforations.

12. The method of claim 8, further comprising separating said nut from said slotted portion by a washer.

* * * * *